US006856188B2

(12) United States Patent
Corsi et al.

(10) Patent No.: US 6,856,188 B2
(45) Date of Patent: Feb. 15, 2005

(54) CURRENT SOURCE/SINK WITH HIGH OUTPUT IMPEDANCE USING BIPOLAR TRANSISTORS

(75) Inventors: Marco Corsi, Parker, TX (US); William J. Bright, Dallas, TX (US); Martin Kithinji Kinyua, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/447,176

(22) Filed: May 28, 2003

(65) Prior Publication Data

US 2004/0239410 A1 Dec. 2, 2004

(51) Int. Cl.[7] ..... G05F 1/10
(52) U.S. Cl. ..... 327/538
(58) Field of Search ..... 323/312, 315, 323/316; 327/530, 534, 535, 537, 538, 543

(56) References Cited

U.S. PATENT DOCUMENTS 4,345,217 A * 8/1982 Pace ..... 330/288
4,855,618 A * 8/1989 Brokaw ..... 327/542
5,512,815 A * 4/1996 Schrader ..... 323/315
6,664,842 B1 * 12/2003 Pobanz ..... 327/436

* cited by examiner

*Primary Examiner*—Jeffrey Zweizig
(74) *Attorney, Agent, or Firm*—W. Daniel Swayze, Jr.; W. James Brady; Frederick J. Telecky, Jr.

(57) ABSTRACT

A circuit and method that provides a cascode current source/sink with high output impedance. In one example, the dependency on the external load is reduced by directing a compensation current corresponding to change in base current in the cascode (Q1) in an approach such that the compensation current cancels out the error of the cascode (Q1). In a further example, biasing circuitry (200) is included and arranged such that change in base current of the cascode (Q1) is detected and a corresponding current is summed at the emitter of the cascode (Q1) such that the collector current of the cascode (Q1) remains unchanged.

16 Claims, 4 Drawing Sheets

100

Bias
$I_{BC}$
$Q_1$
$I_{out}$
$V_{out}$
$I_{in}$
$Q_{IN1}$
$Q_{out}$
$Q_{IN2}$
11
$R_3$
$R_2$
$R_1$

200

11
$I_{bias}$
$I_S$
$I_{out} \approx I_{in} - I_{Bias}$
$I_{in}$
$I_{BC}$
$Q_1$
$V_{out}$
$Q_2$
$Q_{OUT}$
$R_1$

CURRENT SOURCE/SINK WITH HIGH OUTPUT IMPEDANCE USING BIPOLAR TRANSISTORS

BACKGROUND OF THE INVENTION

1. Technical Field of the Invention

The present invention generally relates to the art of electrical current sources/sinks and, more particularly, to a current source with improved output impedance using bipolar transistors.

2. Description of Related Art

Many circuits require current sources/sinks that are relatively constant and highly insensitive to changes in supply. In addition, a most desirable characteristic of current source/sink circuits is a high output resistance or impedance. This improves the accuracy for the output signal and results in a high voltage gain for the circuit if the circuit is used as an active load in an amplifier for example. When using PNP/NPN bipolar transistors cascode current sources/sinks, two problems in particular arise, base currents and base current modulation, contribute to undesirable variations to the output. Base currents, and hence base current errors, result from finite transistor Beta. In contrast, finite Early voltage and/or changes in the output voltage lead to base current modulation errors. The above-described errors within the cascode transistor limit the output impedance of the final circuit. It would be desirable to provide a current source/sink circuit that removes these limitations.

SUMMARY OF THE INVENTION

The present invention provides technical advantages as a circuit and method that provides a cascode current source/sink with high output impedance. In one embodiment, the dependency on the external load is reduced by directing a compensation current corresponding to change in base current in the cascode in an approach such that the compensation current cancels out the error of the cascode. In a further embodiment, the biasing is arranged such that change in base current of the cascode is summed at the emitter of the cascode such that the collector current of the cascode remains unchanged.

BRIEF DESCRIPTION OF THE DRAWINGS

For a more complete understanding of the present invention, reference is made to the following detailed description taken in conjunction with the accompanying drawings wherein.

DETAILED DESCRIPTION OF THE INVENTION

Figure 1:
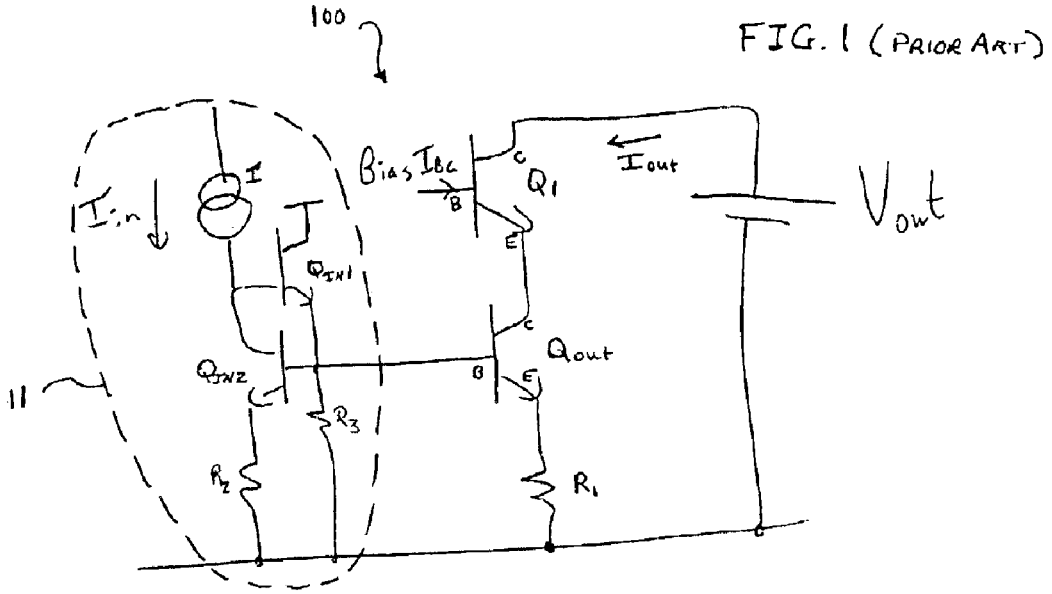
FIG. 1 (PRIOR ART)
FIG. 1 shows a circuit diagram of a conventional cascode current source/sink.

The numerous innovative teachings of the present application will be described with particular reference to the presently preferred exemplary embodiments. However, it should be understood that this class of embodiments provides only a few examples of the many advantageous uses and innovative teachings herein. In general, statements made in the specification of the present application do not necessarily delimit any of the various claimed inventions. Moreover, some statements may apply to some inventive features, but not to others.

Throughout the drawings, it is noted that the same reference numerals or letters will be used to designate like or equivalent elements having the same function. Detailed descriptions of known functions and constructions unnecessarily obscuring the subject matter of the present invention have been omitted for clarity.

By definition, a current source will supply a constant current irrespective of the magnitude and frequency of the applied voltage. A bipolar junction transistor is itself a voltage controlled current source. However, for practical BJT current sources, the output current may vary as the applied voltage changes. A cascode current device is a commonly used cure all to improve a current source/sink's immunity to change in voltage. Referring to FIG. 1 there is illustrated a conventional cascode current device 100 which is often used as the output stage of an amplifier. Typically, a transistor $Q_1$ (referred to as the cascode transistor) is coupled in series between the output transistor $Q_{out}$ and the output $V_{out}$. The cascode current device 100 also includes a corresponding current mirror ratio circuit or input amplifier stage, such as that shown in the dashed lines at item 11, coupled in parallel and to the base of the output transistor $Q_{out}$. Typically, there is also a feedback resistor $R_1$ coupled in series with the emitter of the output transistor $Q_{out}$. The circuit configuration of item 11 can include, for example, a constant current source I coupled to the base of transistor $Q_{IN1}$ and the collector of transistor $Q_{IN2}$ in which the collector of $Q_{IN1}$ is coupled to the power supply and the emitter is coupled to the base of $Q_{IN2}$, and the emitter of $Q_{IN2}$ is coupled to the reference through $R_2$ and the base is coupled to the reference through $R_3$.

The above-described cascode configuration has the effect of reducing the dependency of the circuit 100 on the output voltage $V_{out}$ such that the reaction of the output transistor $Q_{out}$ to changes in output voltage $V_{out}$ is reduced. However, when cascoding a current source/sink with a PNP/NPN bipolar transistor the output impedance of the final circuit is limited by the Beta and Early voltage of the cascode transistor $Q_1$ and impact ionization within the cascode transistor $Q_1$. As Vout is varied the bias current $I_{bc}$ of the cascode transistor $Q_1$ changes causing error in $I_{out}$.

Figure 2:
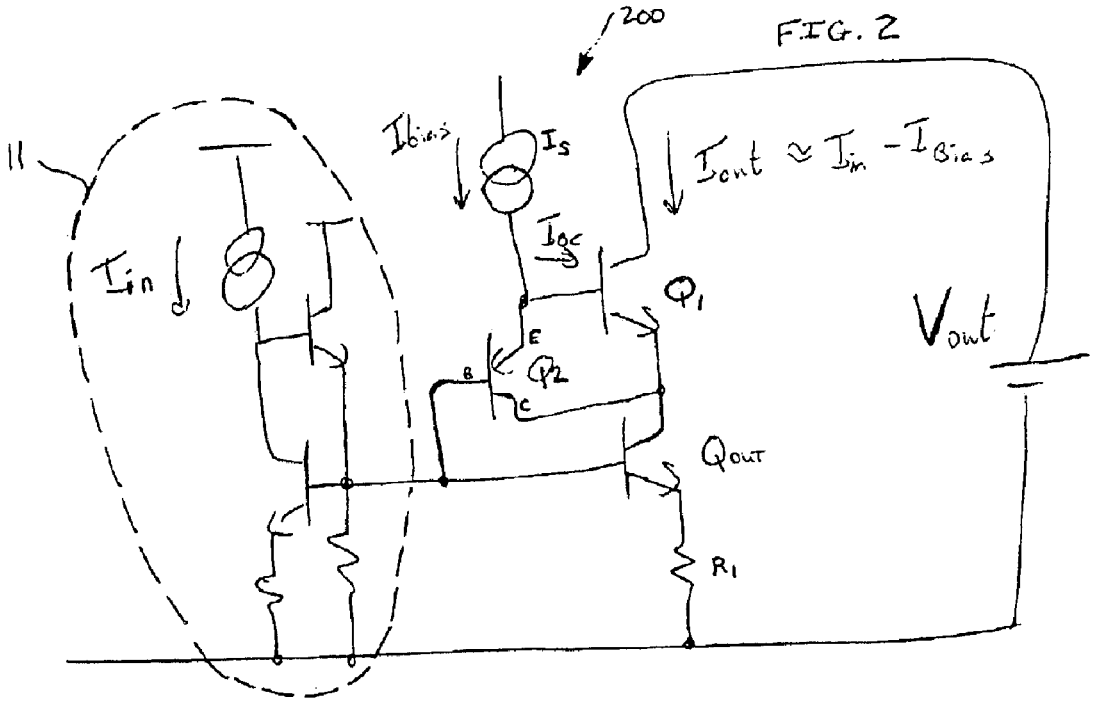
FIG. 2 illustrates a circuit diagram of a NPN version of a current source/sink in accordance with an exemplary embodiment of the present invention.

Referring now to FIG. 2 there is illustrated a circuit diagram of a NPN version of a current sink 200 in accordance with an exemplary embodiment of the present invention. Circuit 200 is the same as the circuit 100 illustrated in FIG. 1 except for the addition of constant current source $I_s$ and transistor $Q_2$. $I_s$ coupled between the power supply and the base of cascode transistor $Q_1$ and the emitter of transistor $Q_2$. The emitter of $Q_2$ is coupled to the base of the cascode transistor $Q_1$, the collector is coupled to the emitter of the cascode transistor $Q_1$, and the base is coupled to the base of the output transistor $Q_{out}$. With this configuration, current source $I_s$ and transistor $Q_2$ cooperatively work as a type of proactive fault device which directs the changing base current of $Q_1$ back to the emitter of $Q_1$. More specifically, the base current in $Q_1$ changes as Vout varies but, since the current in $Q_2$ changes by the same amount, the change is summed at the emitter of $Q_1$ canceling out the effect. Thus, the collector current or $I_{out}$ does not change, thereby increasing the output impedance. Additionally, impact ionization current of the cascode transistor $Q_1$ which tends to lower output impedance is also canceled.

Figure 3:
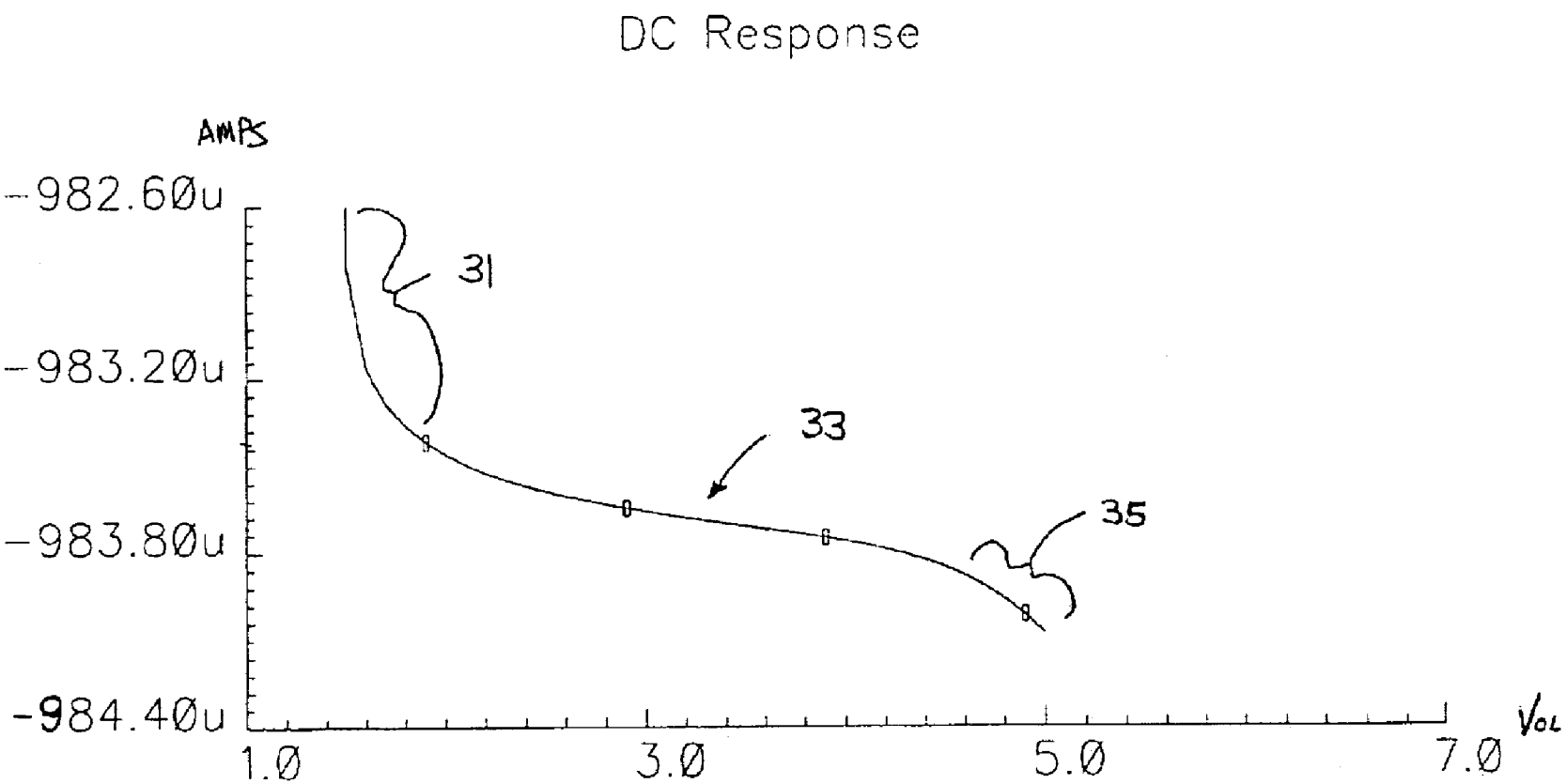
FIG. 3 illustrates an output of current verses voltage for the conventional current sink illustrated in FIG. 1.

FIG. 3 illustrates an output plot of current verses voltage for the conventional current sink illustrated in FIG. 1. The saturation region can generally be seen at item 31 and the impact ionization region can be generally seen at item 35. The slope of the curve seen at item 33 illustrates the error.

Figure 4:
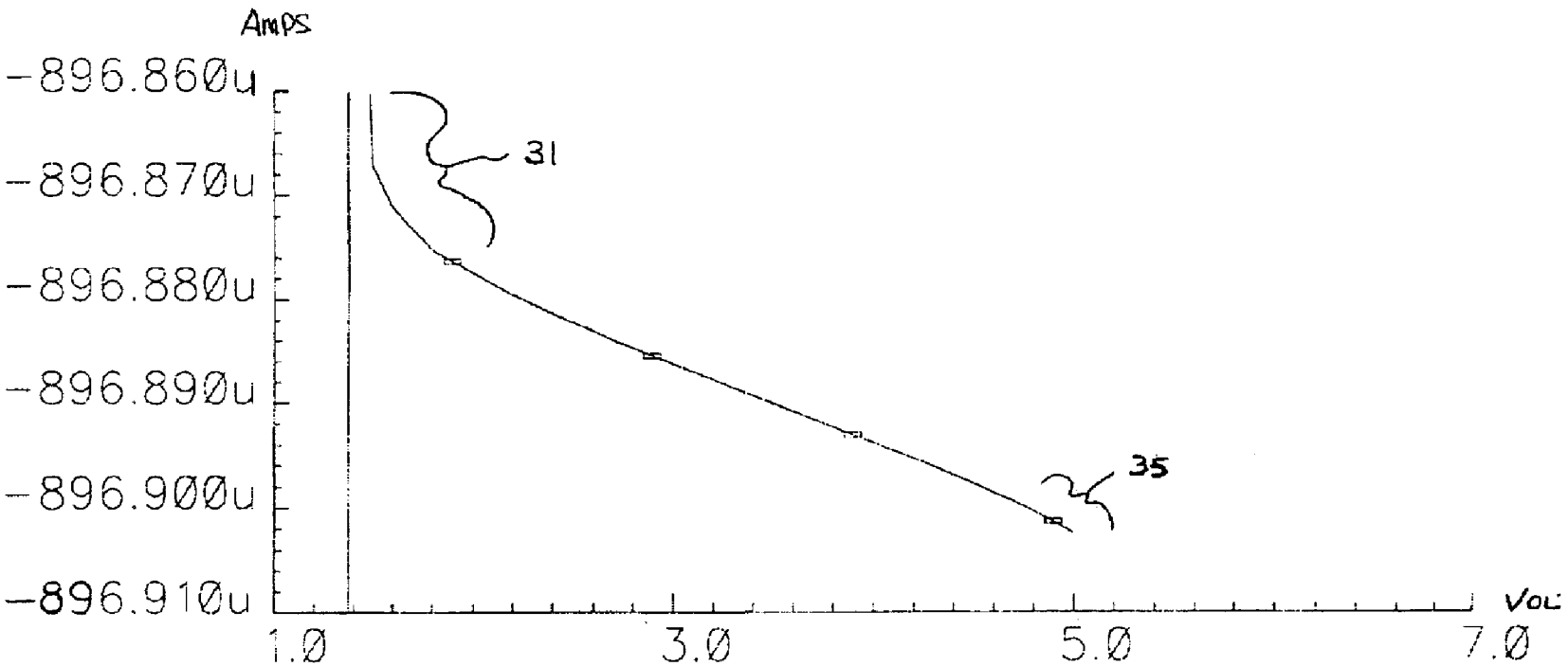
FIG. 4 illustrates an output current and verses voltage for the circuit design illustrated in FIG. 2.

FIG. 4 illustrates an output plot of current and verses voltage for the circuit design illustrated in FIG. 2. Notice in the impact ionization 35 of FIG. 3 is almost completely cancelled. Also, notice the slope between saturation 31 and impact ionization 35 is at a lower level and much more flat.

Figure 5:
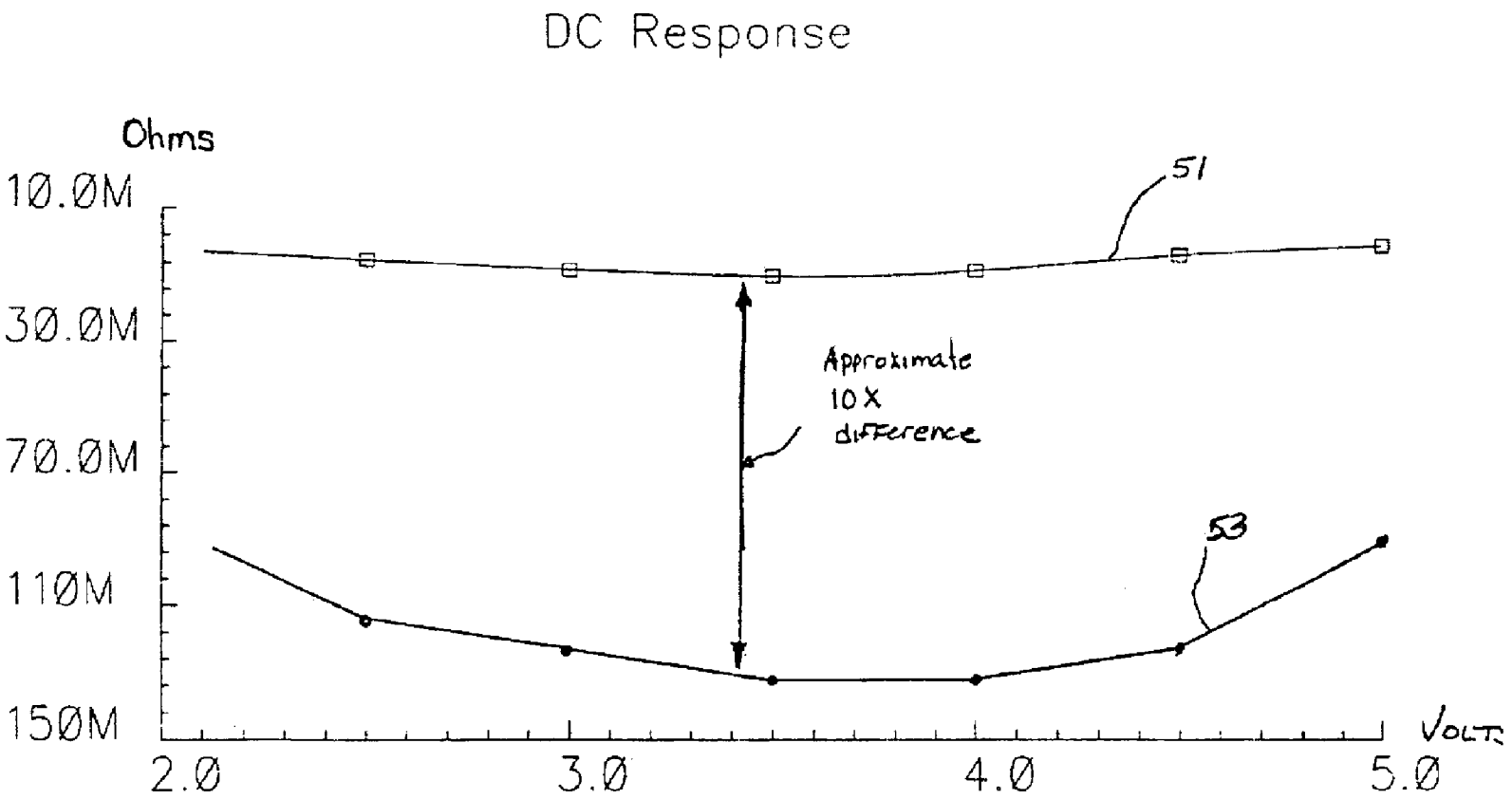
FIG. 5 illustrates the impedance in ohms of the conventional current sink illustrated in FIG. 1 and the circuit design illustrated in FIG. 2.

FIG. 5 generally shows the derivative of the plots shown in FIGS. 3 and 4. The plots show the impedance in ohms versus voltage for the conventional current sink illustrated in FIG. 1 (shown by item 51) and the circuit design illustrated in FIG. 2 (shown by item 53). Note that an improvement of approximately a ten fold is made in the impedance.

Although a preferred embodiment of the method and system of the present invention has been illustrated in the accompanied drawings and described in the foregoing detailed description, it is understood that the invention is not limited to the embodiments disclosed, but is capable of numerous rearrangements, modifications, and substitutions without departing from the spirit of the invention as set forth and defined by the following claims.

What is claimed is:

1. A method for increasing output impedance of a current source/sink which includes circuitry for providing an output current to an external load, said circuitry including a first bipolar junction transistor (BJT) having a base, collector and emitter, said first BJT coupled in series with a second BJT having a base, collector and emitter, wherein said emitter of said first BJT is coupled to said collector of said second BJT and the external load is coupled between said collector of said first BJT and said emitter of said second BJT, said method comprising:

detecting base current variance in said first BJT; and compensating for said detected base current variance by continuously applying a current to said first BJT emitter and said second BJT corresponding to the detected base current variation.

2. The method of claim 1 further including applying a constant current to said first BJT base and an emitter of a third BJT also having a base and a collector, said third BJT base is coupled to said second BJT base, and said third BJT collector is coupled to said first BJT emitter.

3. The method of claim 2 further including applying said compensation current via said third BJT collector to said first BJT emitter responsive to variation in the base current of said first BJT.

4. The method of claim 1, wherein said compensation current is approximately equal to the base current error.

5. The method of claim 1 further including varying said compensation current to corresponds to variation in the base current of said first BJT due to variations in the external load voltage.

6. The method of claim 1 further compensating for said first BJT base current variance due to beta and impact ionization of said first BJT and due to variation of the external load.

7. A device for increasing output impedance of a current amplifier which provide a current to an external load, the current amplifier having an input stage and an output stage, the output stage including a transistor having a base, collector and emitter in cascode with an output transistor having a base, collector and emitter, the fault device comprising:

a means for detecting base current variance in said cascode transistor; and a means for compensating for said detected base current variance by continuously applying a variable current to the cascode transistor emitter and the output transistor collector, said variable current corresponding to the detected base current variation.

8. The device of claim 7, wherein said means for detecting includes means for detecting variation in the base current of said cascode transition due to Beta and impact ionization of said cascode transistor and due to variation in the external load voltage.

9. The device of claim 7, wherein said means for detecting comprises a node for receiving a constant current, wherein said node sources the base current of said cascode transistor and said means for compensating such that when the cascode transistor base current increases current to the means for compensating decreases by a corresponding amount and when the base current decreases current to the means for compensating increases by a corresponding amount.

10. The device of claim 9, wherein said means for compensating comprising a bipolar junction transistor having a base, collector and emitter, wherein said emitter is coupled to said node and said collector is coupled to said output transistor for applying an additive current which directly corresponds to base current increase and base current decrease of said cascode transistor.

11. A current amplifier comprising:

an input stage for providing a reference current; and an output stage having first circuitry operable to source an output current to an external load, said circuitry including a first bipolar junction transistor (BJT) having a base, collector and emitter, said first BJT coupled in series with a second BJT having a base, collector and emitter, wherein said emitter of said first BJT is coupled to said collector of said second BJT and the external load is coupled between said collector of said first BJT and said emitter of said second BJT;

said output stage further having second circuitry coupled to said first BJT and said second BJT and operable to compensate for base current error in said first BJT by continuously applying a current corresponding to the base current error to said first BJT transistor emitter.

12. The current amplifier of claim 1, wherein said second circuitry includes a current source operable for applying a constant current and coupled to said first BJT base and an emitter of a third BJT also having a base and a collector, said third BJT base is coupled to said second BJT base, and said third BJT collector is coupled to said first BJT emitter.

13. The current amplifier of claim 12, wherein said third BJT collector applies said compensation current to said first BJT emitter responsive to variation in the base current of said first BJT.

14. The current amplifier of claim 11, wherein said compensation current is approximately equal to the base current error.

15. The current amplifier of claim 11, wherein said second circuitry is further operable to vary said compensation current to correspond to variation in the base current error due to variations in the external load voltage.

16. The current amplifier of claim 11, wherein said second circuitry is further operable to compensate for the base current error due to beta and impact ionization of said first BJT and due to variation of the external load.

* * * * *